US010756489B2

(12) United States Patent
Hu et al.

(10) Patent No.: US 10,756,489 B2
(45) Date of Patent: Aug. 25, 2020

(54) CARD EDGE CONNECTOR WITH IMPROVED GROUNDING MEMBER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Lai-Ang Hu, Kunshan (CN); Wen-Jun Tang, Kunshan (CN); Teng Qin, Kunshan (CN); Xue-Wu Bu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/553,129

(22) Filed: Aug. 27, 2019

(65) Prior Publication Data

US 2020/0076131 A1 Mar. 5, 2020

(30) Foreign Application Priority Data

Aug. 28, 2018 (CN) ..... 2018 2 1390392 U

(51) Int. Cl.
*H01R 13/646* (2011.01)
*H01R 12/72* (2011.01)
(Continued)

(52) U.S. Cl.
CPC ..... *H01R 13/646* (2013.01); *H01R 12/721* (2013.01); *H01R 12/737* (2013.01);
(Continued)

(58) Field of Classification Search
CPC .. H01R 13/646; H01R 12/721; H01R 12/737; H01R 13/405; H01R 13/518; H01R 12/73; H01R 13/6594; H01R 13/6597
(Continued)

(56) References Cited

U.S. PATENT DOCUMENTS 3,587,029 A * 6/1971 Knowles ..... H01R 13/6471 439/607.34
5,035,631 A * 7/1991 Piorunneck ..... H01R 23/688 439/108

(Continued)

FOREIGN PATENT DOCUMENTS

CN 204858048 U 12/2015
CN 204858048 Y 12/2015
CN 106356676 A 1/2017

*Primary Examiner* — Travis S Chambers
(74) *Attorney, Agent, or Firm* — Wei Te Chung; Ming Chien Chang

(57) ABSTRACT

A card edge connector includes a housing defining a card slot, a terminal module and a grounding member. The terminal module includes two rows of terminals and an insulating base with a first surface, a second surface and end surfaces between and connecting with the first and second surfaces. Each row of terminals includes a plurality of signal terminals and a plurality of grounding terminals. The terminals includes contacting sections extending out the first surface of the insulating base and into the card slot, leg sections extending out the second surface of the insulating base, and connecting sections. The grounding member fitly surrounds the end surfaces of the insulating base and includes a group of first contacting arms and a group of second contacting arms, each grounding terminal is contacted with one first contacting arm and one second contacting arm.

9 Claims, 14 Drawing Sheets

(51) Int. Cl.

| | |
|---|---|
| ***H01R 13/405*** | (2006.01) |
| ***H01R 12/73*** | (2011.01) |
| ***H01R 13/6594*** | (2011.01) |
| *H01R 13/518* | (2006.01) |

(52) U.S. Cl.
CPC ..... *H01R 13/405* (2013.01); *H01R 13/6594* (2013.01); *H01R 13/518* (2013.01)

(58) Field of Classification Search
USPC ..... 439/386, 108, 607.34, 637
See application file for complete search history.

(56) References Cited

U.S. PATENT DOCUMENTS

| | | | | |
|---|---|---|---|---|
| 6,019,616 | A * | 2/2000 | Yagi | H01R 13/6582 439/108 |
| 10,490,920 | B2 * | 11/2019 | Manickam | H01R 12/721 |
| 10,581,206 | B2 * | 3/2020 | Fang | H01R 12/737 |
| 2018/0040971 | A1 * | 2/2018 | Phillips | H01R 12/716 |
| 2019/0173209 | A1 * | 6/2019 | Lu | H01R 12/00 |
| 2019/0214755 | A1 * | 7/2019 | Manickam | H01R 12/721 |
| 2020/0076135 | A1 * | 3/2020 | Tang | H01R 13/502 |

* cited by examiner

CARD EDGE CONNECTOR WITH IMPROVED GROUNDING MEMBER

BACKGROUND OF THE INVENTION

1. Field of the Invention

The invention relates to a card edge connector with at least one grounding member.

2. Description of Related Art

Chinese patent publication No. CN106356676A discloses an electrical connector with two grounding bars. Each grounding bar extends across a row of terminals and includes grounding fingers pressing again corresponding grounding terminals of the row of the terminals. The grounding bars are assembled to the sides of the terminal modules. There's a risk of the grounding bars disengage from the terminal modules.

It is desired to have a card edge connector with improved grounding member.

SUMMARY OF THE INVENTION

Accordingly, an object of the present invention is to provide a card edge connector. The card edge connector comprises an elongate insulating housing defining a card slot, a terminal module and a grounding member. The terminal module comprises two rows of terminals and an insulating base with a first surface, a second surface opposite to the second surface and end surfaces between and connecting with the first and second surfaces. Each row of terminals comprises a plurality of signal terminals and a plurality of grounding terminals. The terminals comprises contacting sections extending out the first surface of the insulating base and into the card slot, leg sections extending out the second surface of the insulating base, and connecting sections joining with the contacting sections and the leg sections, respectively. The grounding member fitly surrounds the end surfaces of the insulating base and comprises a group of first contacting arms and a group of second contacting arms, each grounding terminal is contacted with one first contacting arm and one second contacting arm of the grounding member.

Other objects, advantages and novel features of the invention will become more apparent from the following detailed description when taken in conjunction with the accompanying drawings.

DETAILED DESCRIPTION OF THE PREFERRED EMBODIMENT

FIGS. 1 through 13 illustrate three embodiments of the present invention.

Figure 1:
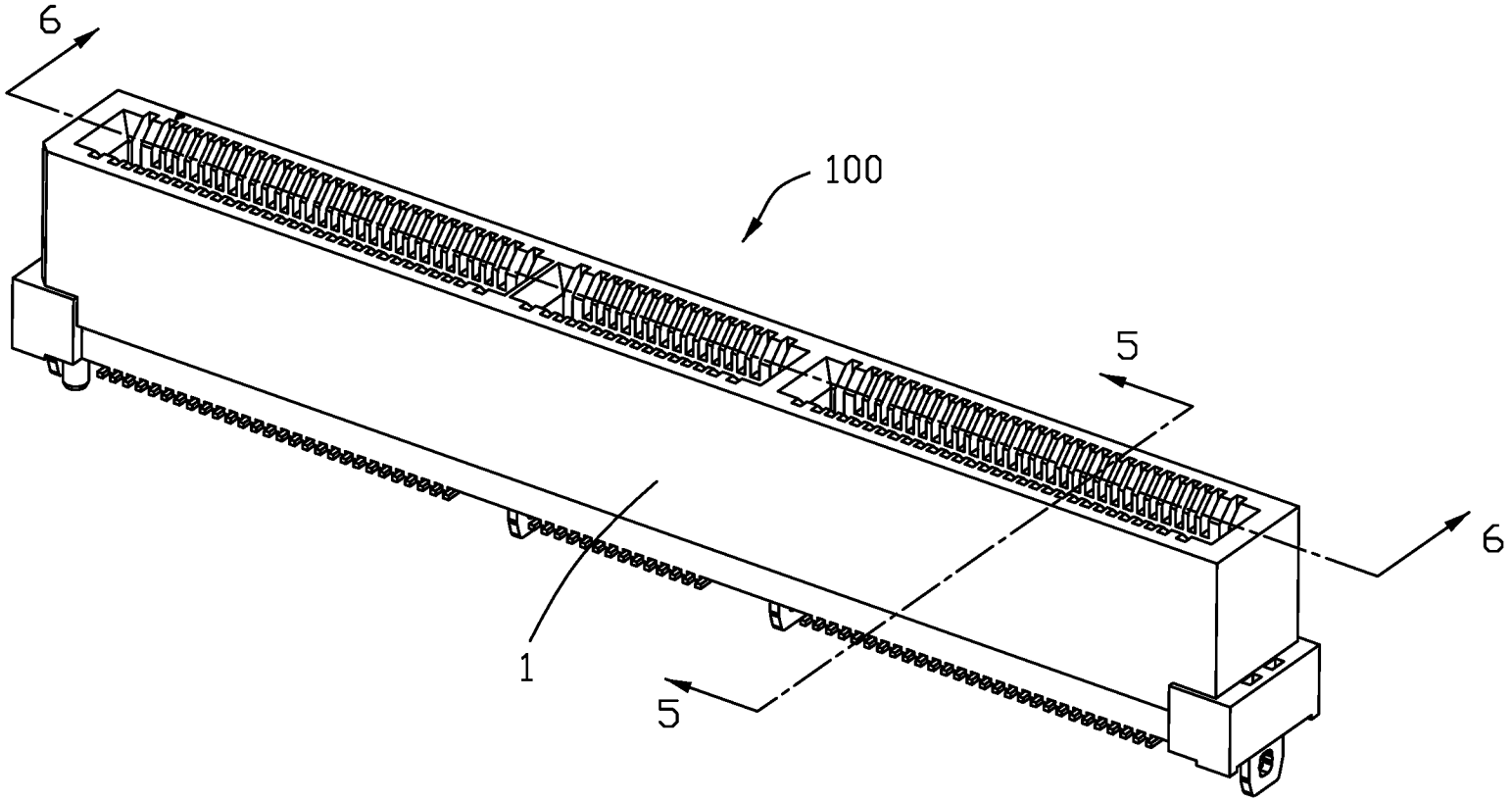
FIG. 1 is a top an perspective view of a card edge connector of a first embodiment according to the invention.
Figure 2:
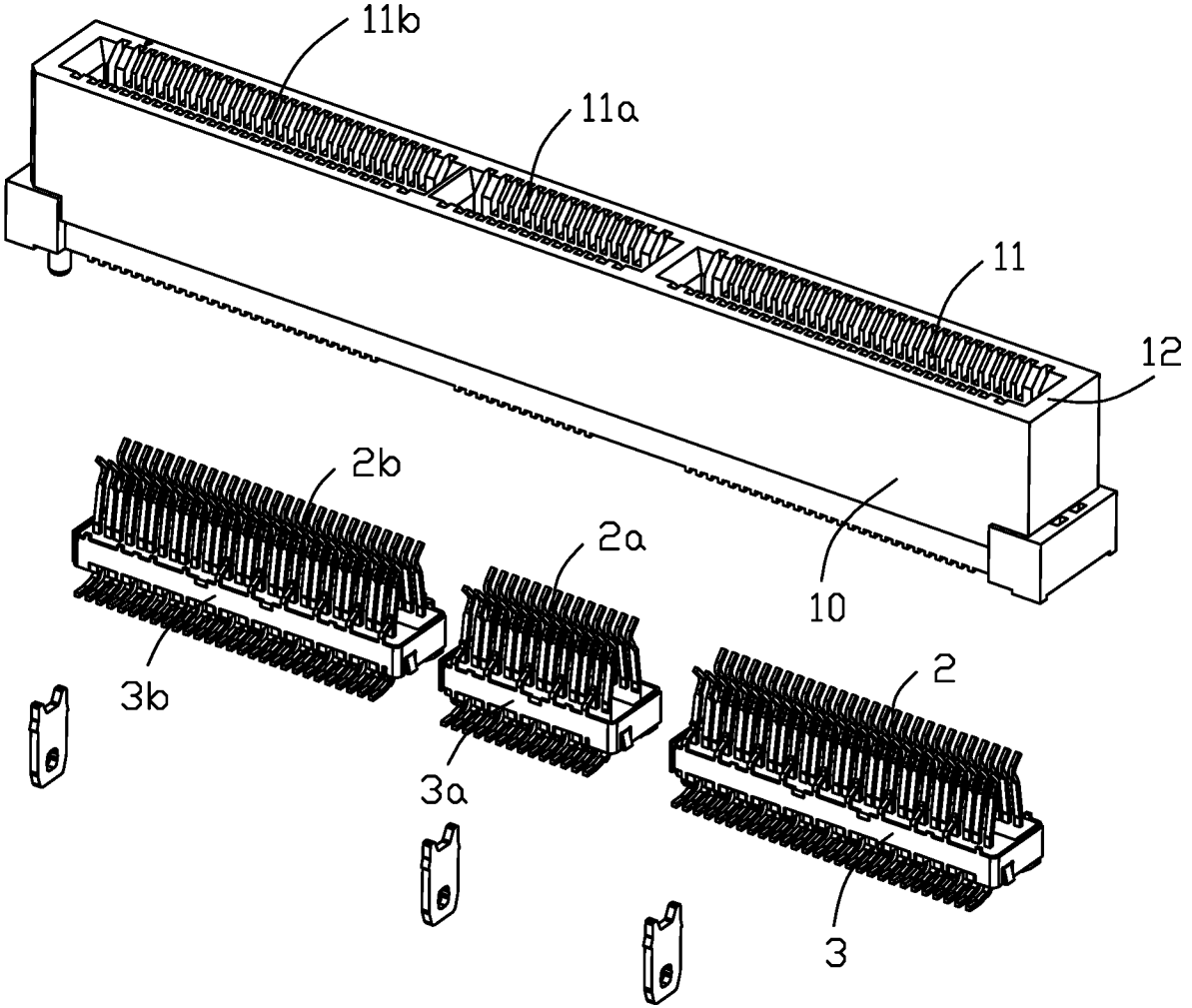
FIG. 2 is an explode perspective view of the card edge connector shown in FIG. 1.
Figure 2A:
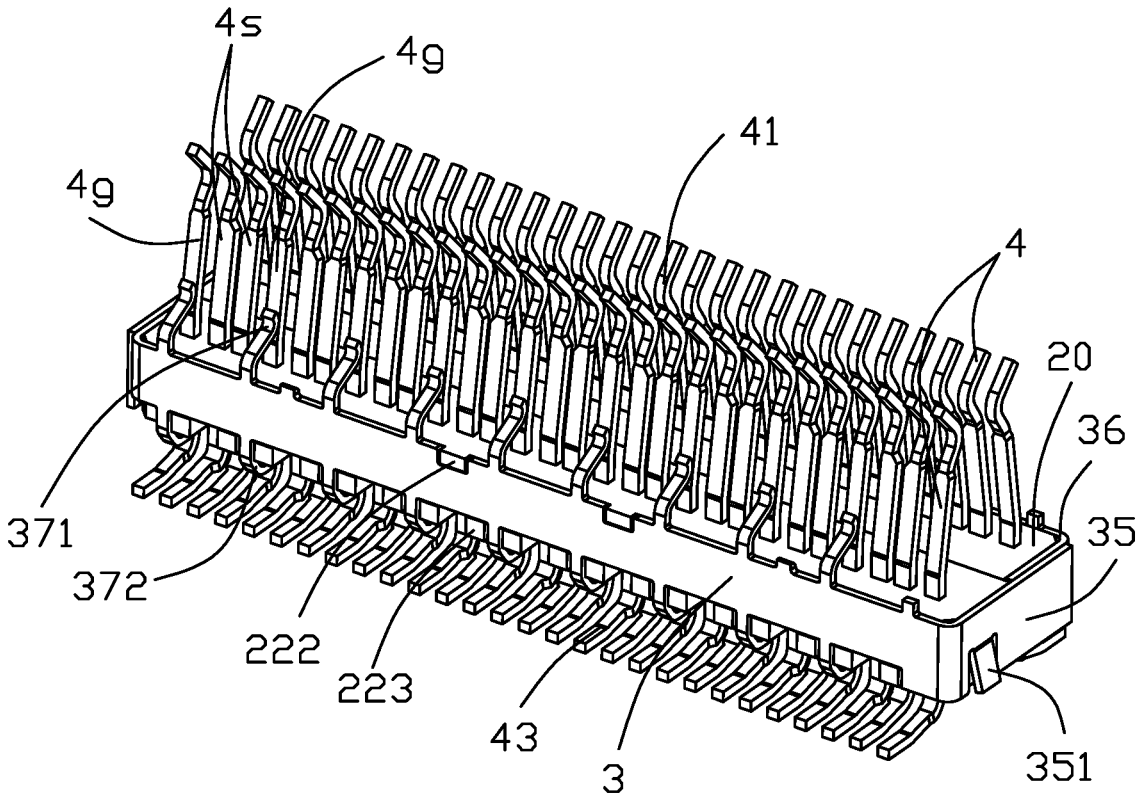
FIG. 2A is a perspective view of one terminal module surrounded with the grounding member shown in FIG. 2.
Figure 5:
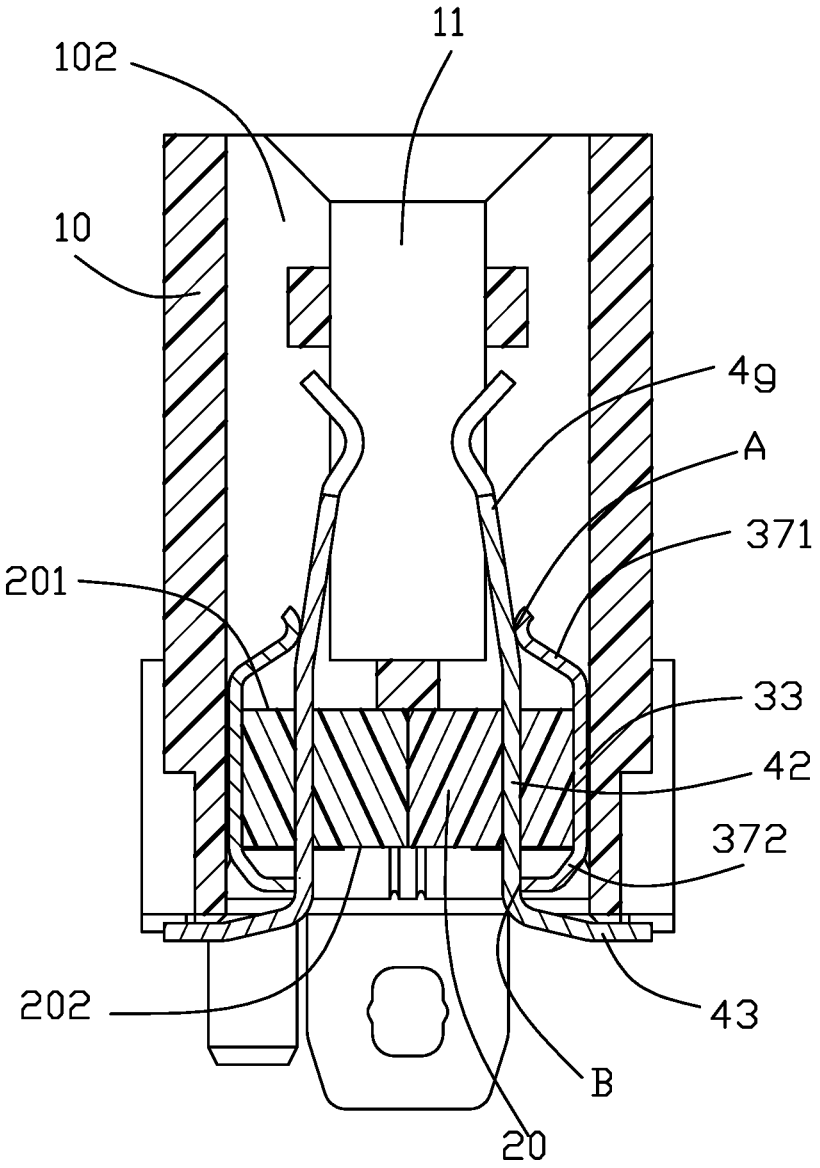
FIG. 5 is a cross-sectional view of the car edge connector taking along broken lines 5-5 in FIG. 1.

Referring to FIGS. 1 through 6 illustrating a first embodiment of the invention, a card edge connector 100 in a vertical type, includes an elongate insulating housing 1, a terminal module 2 and a grounding member 3 surrounding the terminal module 2. The insulating housing 1 defining a card slot 11 between two opposite long walls 10, i.e., a first long wall and a second long wall and two opposite short wall 12. As best shown in FIGS. 2*a* and 5, the terminal module 2 includes an insulating base 20 and two rows of terminals 4 retained in the insulating base 20. Each row of terminals 4 includes a plurality of signal terminals 4*s* and a plurality of grounding terminals 4*g* located along the long wall 10. The terminals 4 include contacting sections 41 extending out a first/upper surface 201 of the insulating base 20 and leg sections 43 extending out a second/lower surface 202 of the insulating base 20, the first and the second surface of the insulating base 20 is perpendicular connecting with four end surfaces (not labeled), the end surfaces are of an upright faces in this embodiment. The grounding member 3 is formed in a ring shape and surrounds four end surfaces of the insulating base 20 and further contacts with all the grounding terminals 4*g* of the two rows of terminals 4, thereby improve the electrical performance of high-speed transmission. The grounding member 3 defines a group of first contacting arms 371 and a group of second contacting arms 372, each first contacting arm 371 and corresponding second contacting arm 372 press against two points of a same grounding terminal 4*g*. One of the two points is located above the insulating base 20 and another of the two points is located below the insulating base 20.

As best shown in FIG. 5, the terminal 4 includes a connecting section 42 jointing the contacting section 41 and the leg section 43 adapted for being mounted on a PCB. At least part of the connecting section 42 is embedded in the insulating base 20. The first contacting arms 371 are disposed with an arc shape contacting point A, the point A is formed by the plate surface of a metal plate which makes this contacting arms. The second contacting arms 372 are disposed with a plan contacting point B, the plan contacting point is formed at a cutting face. The terminal module 2 with the grounding member 3 is assembled into the insulating housing 1 from a bottom of the insulating housing 1, the grounding member 3 is interfered with the inside of the long wall 10. The first surface 201 and the second surface 202 of the insulating base 20 is located between a bottom of the card slot 11 and a bottom surface of the insulating housing 1, the contacting sections 41 of the terminals 4 are received in terminal grooves 102.

In this embodiment, the insulating housing 10 further defines two additional car slot 11*a*, 11*b*, three card slots are arrange side by side. Each additional card slot also is loaded with a terminal module 2*a*, 2*b* with a grounding member 3*a*, 3*b* thereon, which are similar to said terminal module 2 except for the quantity of the terminals and the wholly length thereof. Therefore, the description of the additional terminal modules with the grounding members is omitted.

Figure 3:
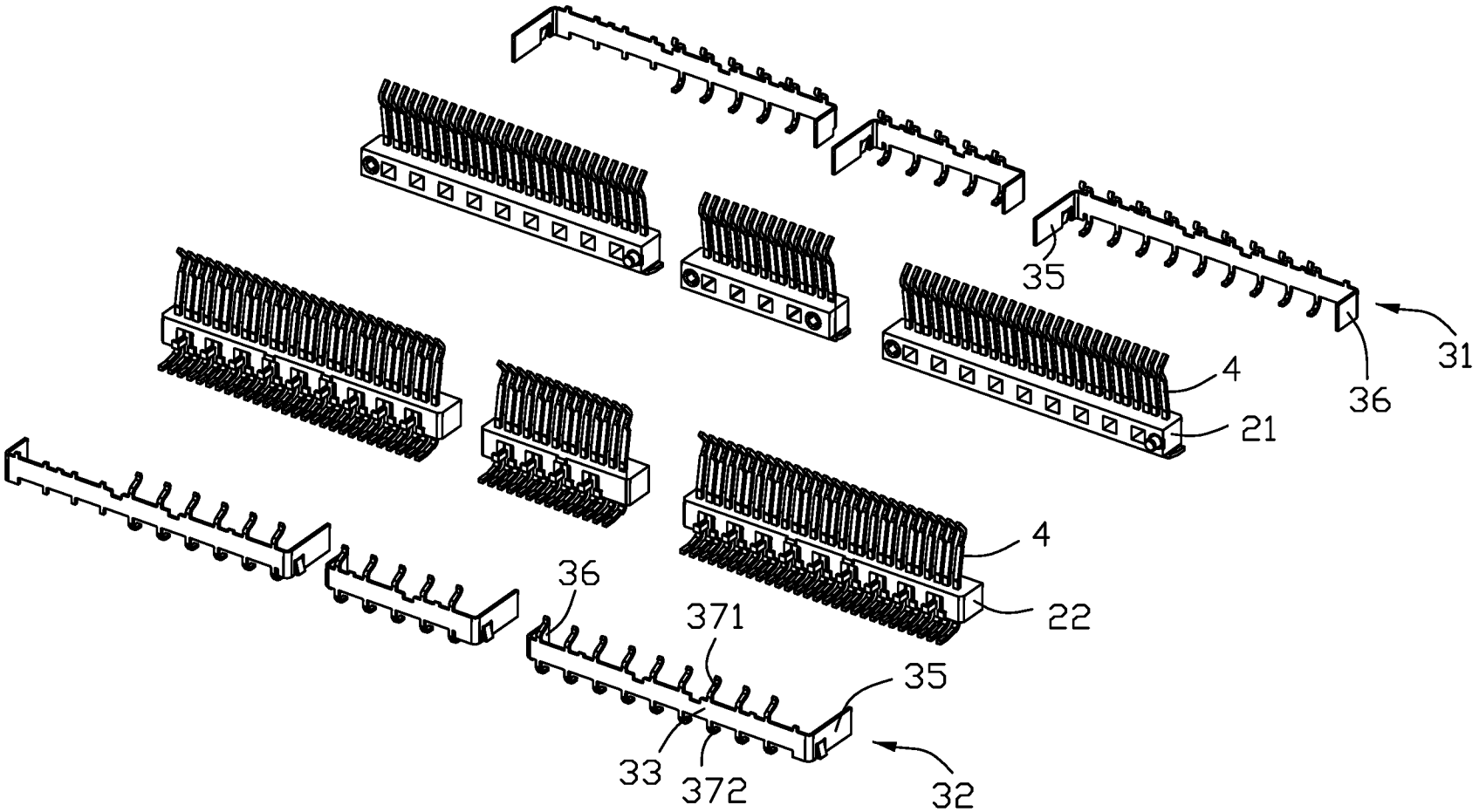
FIG. 3 is a further exploded perspective view of the card edge connector shown in FIG. 2, and the insulating housing is removed.
Figure 4:
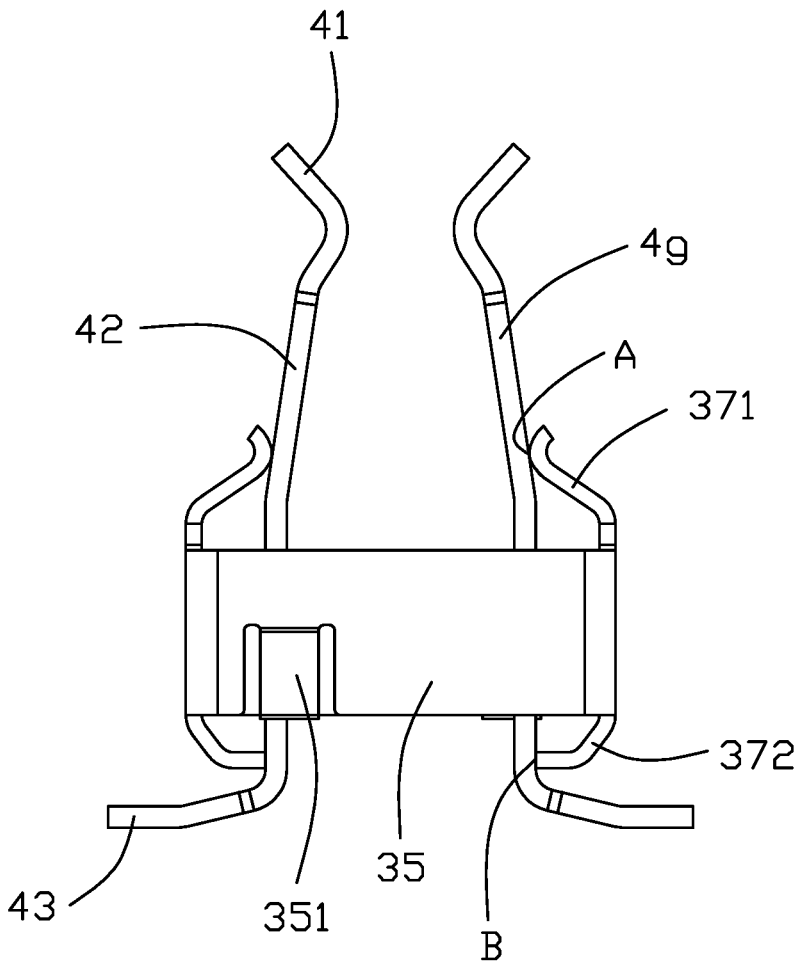
FIG. 4 is a right plan view of the terminal module shown in FIG. 2A.

Referring to FIG. 3, the terminal module 2 consists of two sub-modules, each sub-module is formed with one row of terminals 4 and an insulator 21/22 inserting molded with one row of terminals, the two insulators 21/22 are assembled together as the insulating base 20. The grounding member 3 includes two grounding plates, a first grounding plate 31 and a second grounding plate 32, the two grounding plates are symmetrical. Each of the grounding plates 31/32 includes an elongate plate portion 33 and two end portions 35, 36 bending perpendicularly from two elongate ends of the plate portion 33. The first/upper contacting arms 371 extend slantwise and inward from upper edge of the plate portion 33 and second/lower contacting arms 372 extend slantwise and inwards from lower edge of the plate portion 33. The first and second contacting arms 371372 of the first grounding plate 31 press against the grounding terminals of one row of terminals in the insulator 21, the first and second contacting arms 371372 of the second grounding plate 32 press against the grounding terminals of another row of terminals in the insulator 22.

Two end portions 35, 36 at a same end of the two grounding plates are welded together so as to improve the retaining force of the grounding plates 31, 32 with the insulating base 20. One long portion 35 of the grounding plate is wider than another short portion 36 in a direction perpendicular to the first and second surface.

Figure 6:
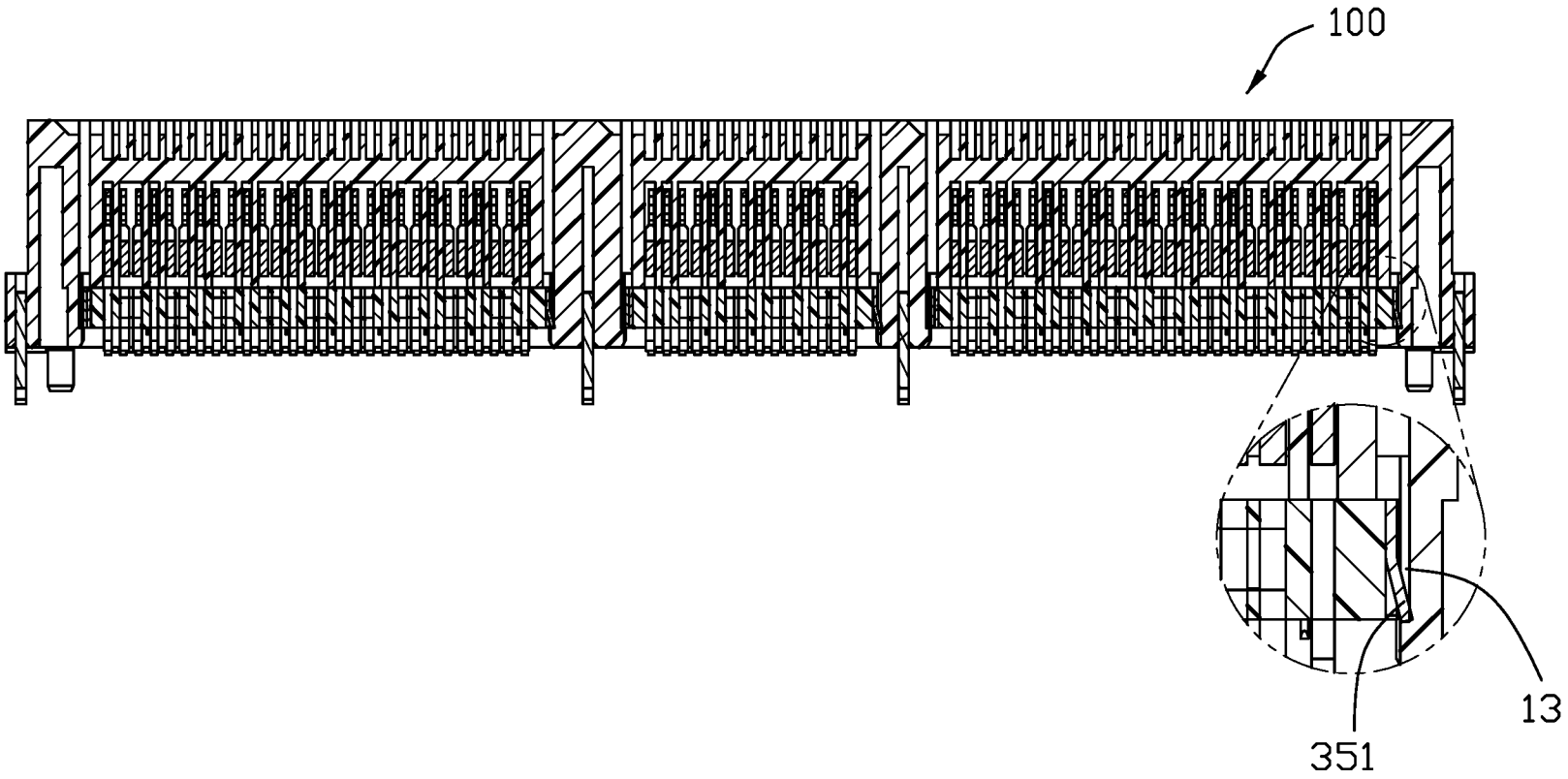
FIG. 6 is a cross-sectional view of the car edge connector taking along broken lines 5-5 in FIG. 1.
Figure 7:
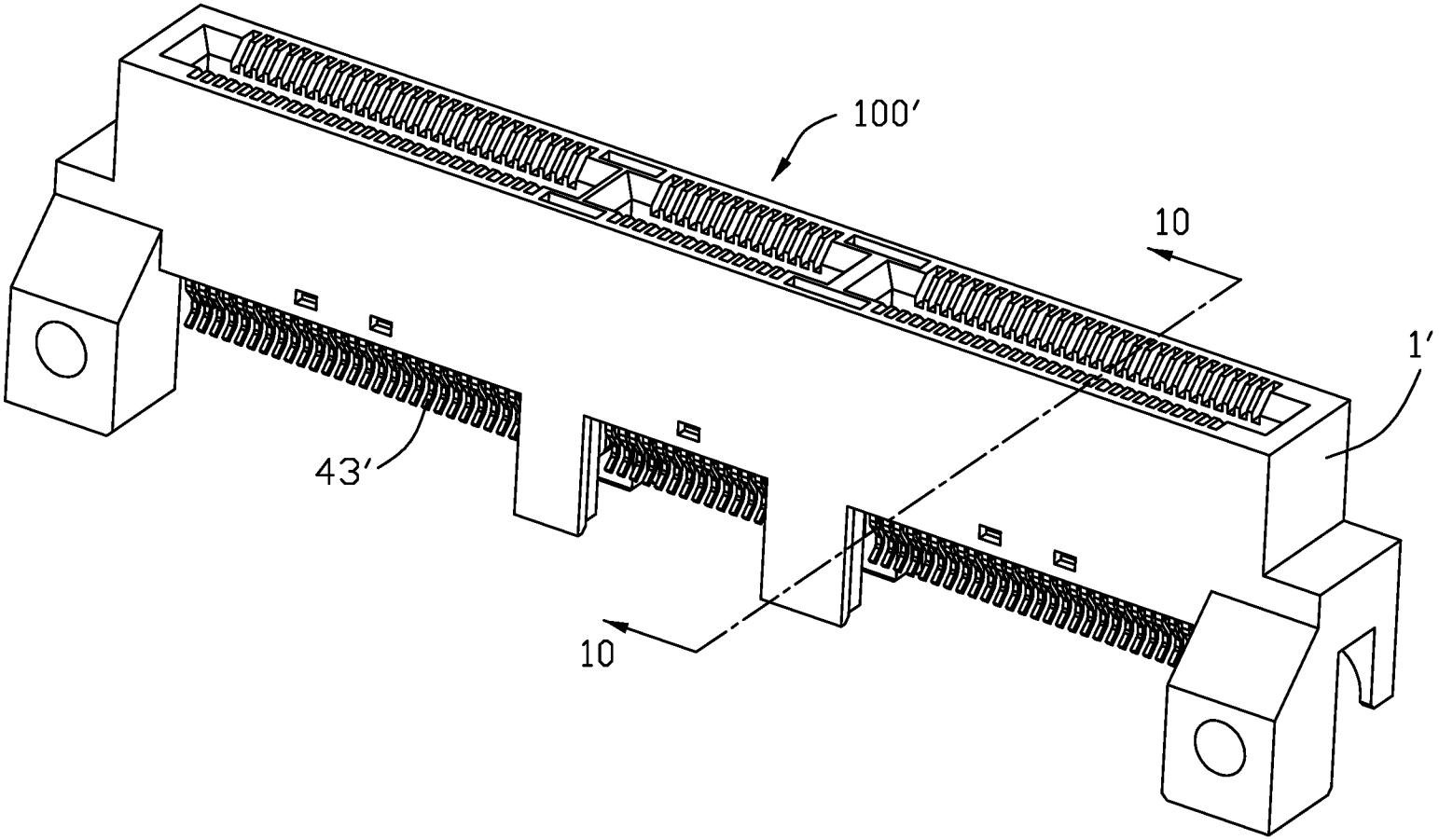
FIG. 7 is a top perspective view of a card edge connector of a second embodiment according to the invention.
Figure 8:
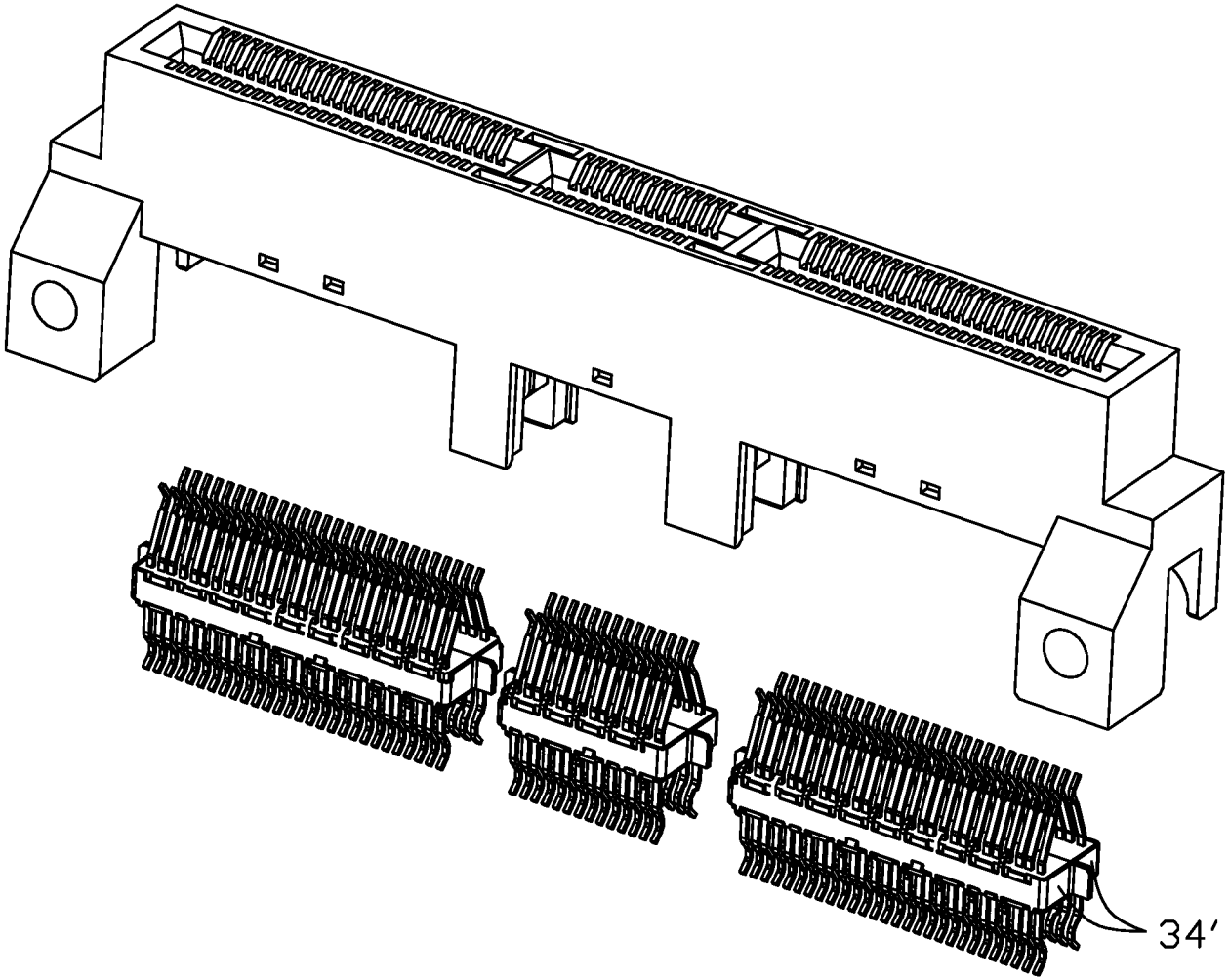
FIG. 8 is a top exploded perspective view of the card edge connector shown in FIG. 7.
Figure 9:
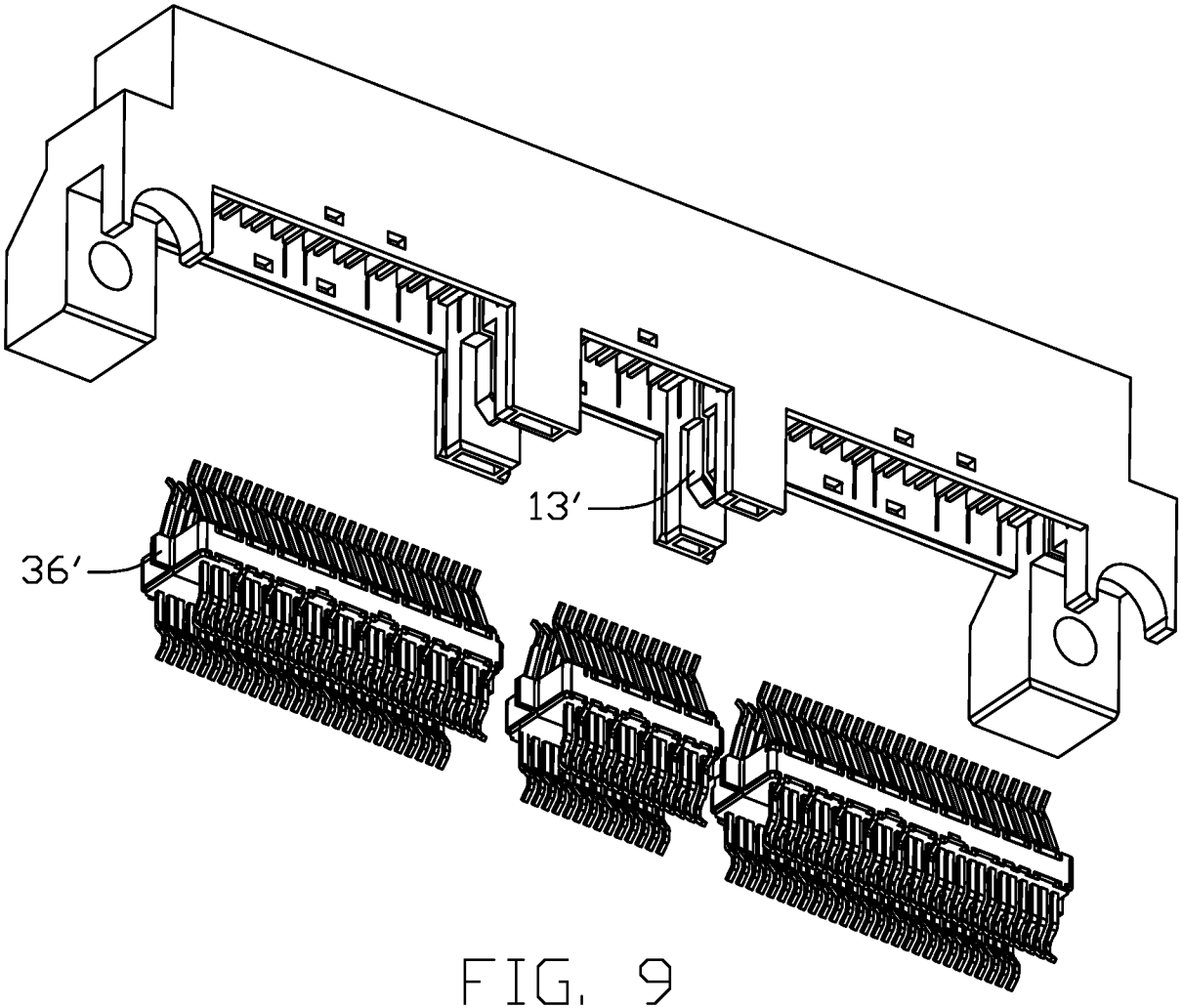
FIG. 9 is a bottom exploded perspective view of the card edge connector shown in FIG. 7.
Figure 10:
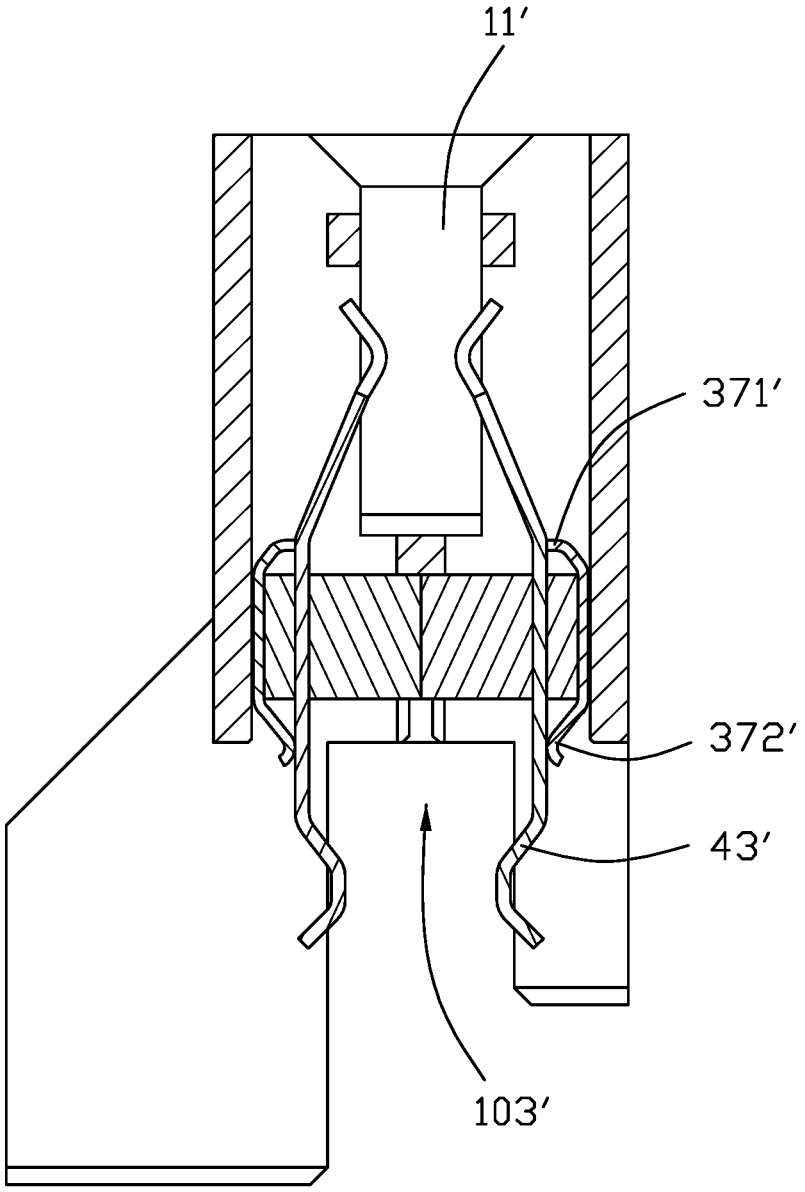
FIG. 10 is a cross-sectional view of the car edge connector taking along broken lines 10-10 in FIG. 7.

Please notes, the two insulators 21, 22 are slightly offset along the longitudinal direction as best shown in FIG. 2*a*, so that the short end portions 36 press against another insulator 22. The plate portions 33 of two grounding plates 31, 32 are retained by upper bosses 222 and lower bosses 223. The long end portion 35 further defines a slant tab 351 pressing against a recess defined in the insulating housing as shown in FIG. 6.

Referring to FIGS. 7 through 10 illustrating a second embodiment of the present invention, a card edge connector 100' of a straddle type is similar to the first embodiment except for part of the grounding plate and the leg portions. The different parts will be described hereinafter. The leg sections 43' are of arc shape and arranged in two rows for defining a PCB receiving slot 103'. The end portions 34' of the two grounding plates are same, a portioning portion 36' bends from the end portion 34', two adjacent positioning portions 36' are welded together and extending outwards, the positioning portions are attached together and welded together. The insulating housing 1' define a slot 13' and the welded positioning portions 36' are received and retained in the slot 13'. The card slot 11' opens upwards and opposite to the PCB receiving slot 103'.

Figure 11:
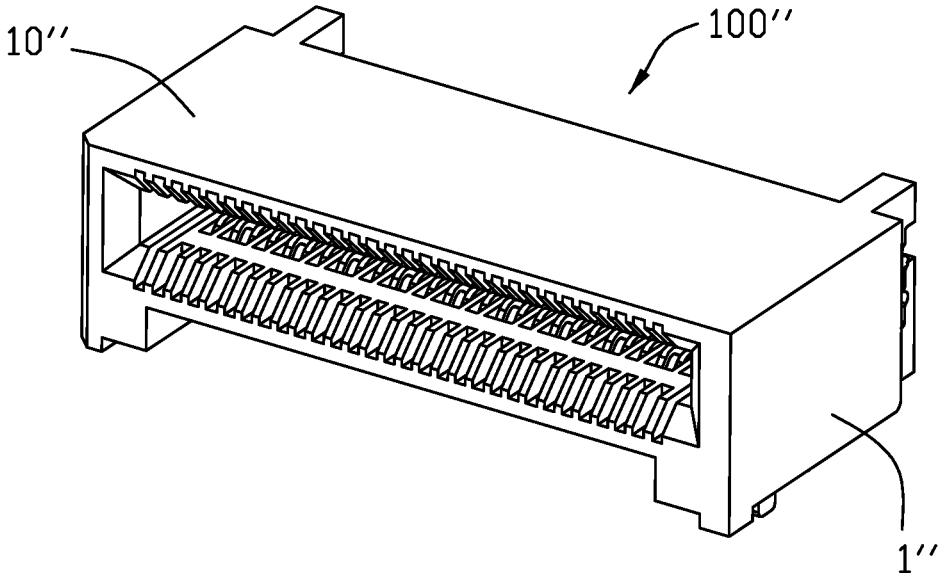
FIG. 11 is a front and top perspective view of a card edge connector of a third embodiment according to the invention.
Figure 12:
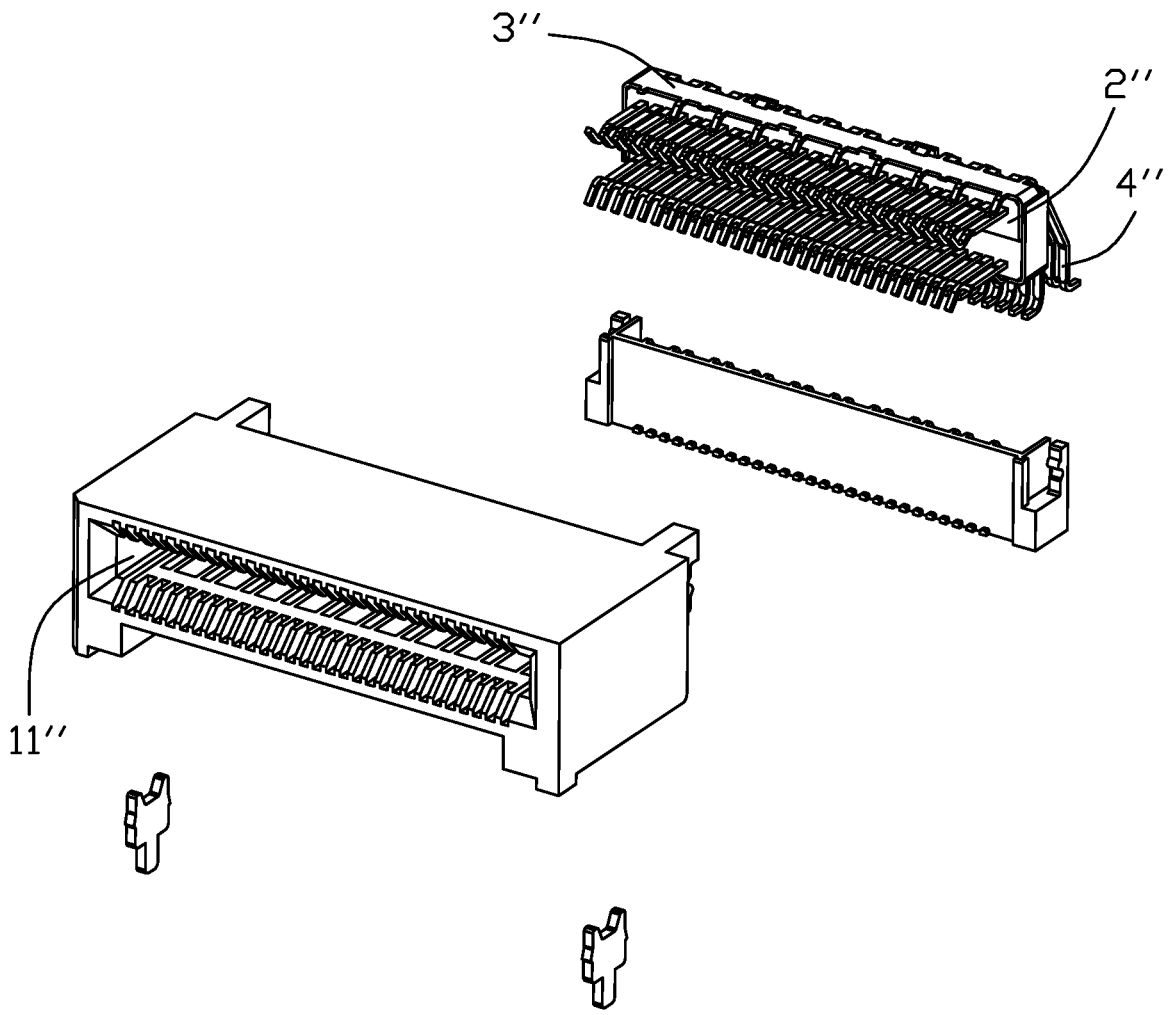
FIG. 12 is an exploded perspective view of the card edge connector shown in FIG. 11.
Figure 13:
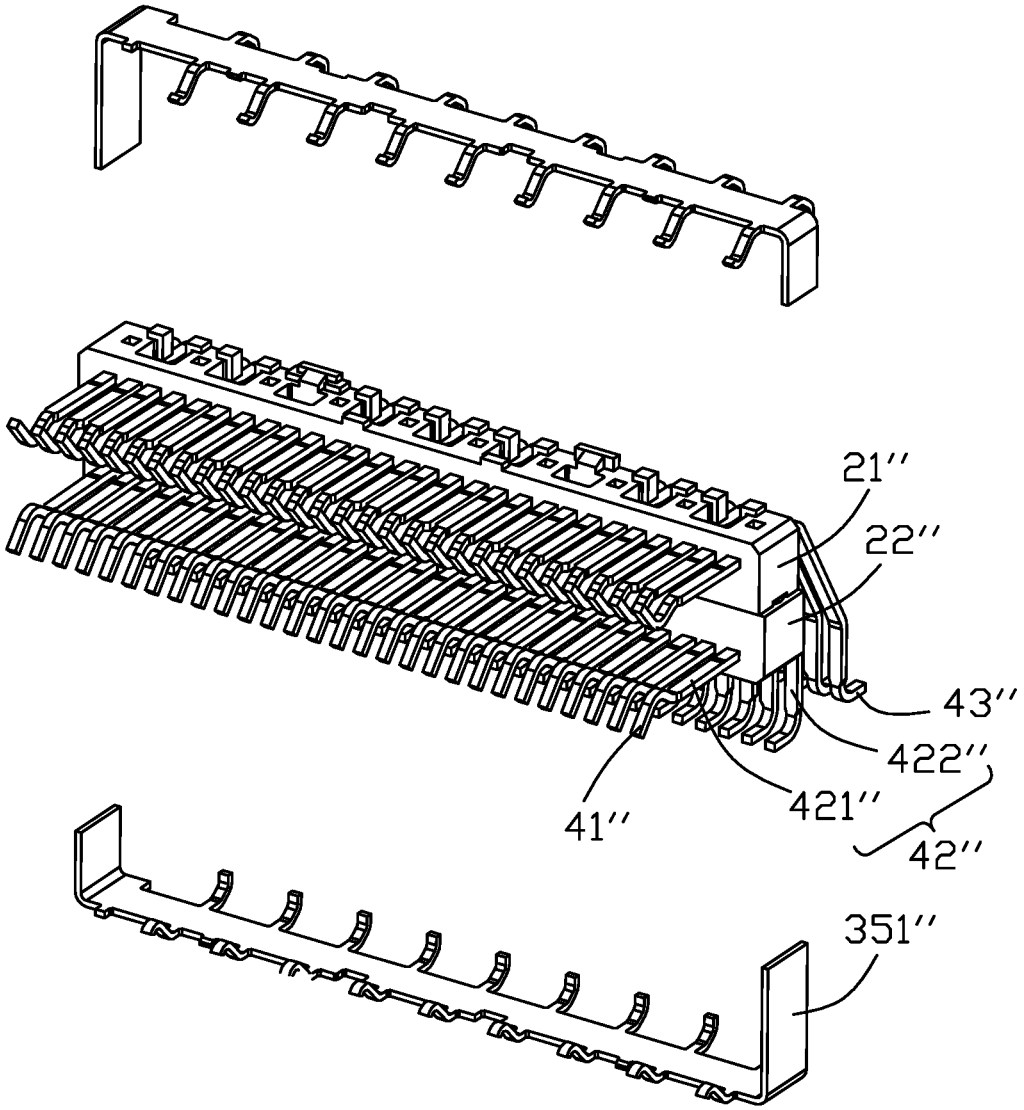
FIG. 13 is a further exploded perspective view of the card edge connector shown in FIG. 12, and the insulating housing is removed.

Referring to FIGS. 11 through 13 illustrating a third embodiment of the present invention, a card edge connector 100" of a right angle type also has a grounding member 3". The different parts will be described hereinafter. The card slot 11 surrounding by upper and lower walls 10" of the insulating housing 1" opens forwards. The contacting sections 41" of the terminals are located in front of a front surface of the insulating base and the leg sections 43" are located at a rear side of the insulating base. The connecting sections 42" includes front horizontal parts 421" and rear upright parts 422" out the insulating base. The grounding member 3" surrounds end surfaces which consist of an upper surface, a right surface, a lower surface and a left surface. The grounding member includes two grounding plates with end portions 351" abutting two ends of the insulators 21", 22". The two insulators are stacked together in an upper and lower direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A card edge connector, comprising:

an elongate insulating housing defining a card slot;

a terminal module comprising two rows of terminals and an insulating base with a first surface, a second surface opposite to the second surface and end surfaces between and connecting with the first and second surfaces; each row of terminals comprising a plurality of signal terminals and a plurality of grounding terminals; the terminals comprising contacting sections extending out the first surface of the insulating base and into the card slot, leg sections extending out the second surface of the insulating base, and connecting sections joining with the contacting sections and the leg sections, respectively; and a grounding member;

wherein the grounding member fitly surrounds the end surfaces of the insulating base and comprises a group of first contacting arms and a group of second contacting arms, each grounding terminal is contacted with one first contacting arm and one second contacting arm of the grounding member.

2. The card edge connector as claimed in claim 1, wherein the grounding member comprises a first grounding plate and a second grounding plate, each grounding plate comprises an elongate plate portion and two end portions, the end portions at a same end of the grounding plates are welded or soldered together.

3. The card edge connector as claimed in claim 2, wherein the first contacting arms extend upwards from an upper elongate side of each plate portion and beyond the first surface while the second contacting portions extend from a lower elongate side of each plate portion and downward below the second surface of the insulating base.

4. The card edge card connector as claimed in claim 2, wherein the insulating base consists of two insulators assembled together, the two rows of terminals are retained in the insulators respectively.

5. The card edge connector as claimed in claim 2, wherein the first contacting arms extend from a front elongate side of each plate portion and forwards beyond the first surface while the second contacting arms extend from a rear elongate side of each plate portion and rearward beyond the second surface of the insulating base.

6. The card edge connector as claimed in claim 5, wherein the first contacting arms are disposed with an arc shape contacting point which is formed by the plate surface of a metal plate which makes the second contacting arms, while the second contacting arms are disposed with a plan contacting point which is formed at a cutting face thereof.

7. The card edge connector as claimed in claim 6, wherein the first contacting arm and the corresponding second contacting arm press against two different points of the connecting sections.

8. A card edge connector, comprising:

an elongate insulating housing defining a card slot between two long walls;

a terminal module comprising two rows of terminals and an insulating base defining a first surface, a second surface opposite to the second surface and end surfaces between the first and second surfaces, the end surfaces comprising two opposite long end surfaces and two opposite short surfaces; each row of terminals comprising a plurality of signal terminals and a plurality of grounding terminals; the terminals comprising contacting sections extending out the first surface of the insulating base and into the card slot, leg sections extending out the second surface of the insulating base, and connecting sections joining with the contacting sections and the leg sections, respectively; and a grounding member;

wherein the grounding member comprises two plate portions covering the long end surfaces of the insulating base and two end portions covering the short end surfaces of the insulating base, a group of first contacting arms and a group of second contacting arms extend from opposite sides of each plate portion and connect with the grounding terminals of each row of terminals.

9. The card edge card connector as claimed in claim 8, wherein the insulating base consists of two insulators assembled together, the two rows of terminals are retained in the insulators respectively; the grounding member comprises a first grounding plate and a second grounding plate each of which comprises said one plate portion and two end portions bending from the plate portion, the end portions of a same end of the first and second grounding plate are welded or soldered together.

* * * * *